US006123526A

United States Patent [19]

Chen et al.

[11] Patent Number: 6,123,526

[45] Date of Patent: Sep. 26, 2000

[54] MULTISTAGE PUMP AND METHOD FOR ASSEMBLING THE PUMP

[75] Inventors: Chun-Chien Chen; Ming-Shinn Liou; Tean-Mu Shen; Jung-Chen Chien; Tsung-Hsin Lin, all of Hsinchu, Taiwan

[73] Assignee: Industrial Technology Research Institute, Hsinchu Hsien, Taiwan

[21] Appl. No.: 09/156,585

[22] Filed: Sep. 18, 1998

[51] Int. Cl.[7] ..... F01C 1/30

[52] U.S. Cl. ..... 418/9; 418/5; 418/13; 418/135

[58] Field of Search ..... 418/9, 135, 13, 418/5; 29/888.02

[56] References Cited

U.S. PATENT DOCUMENTS

| | | | |
|---|---|---|---|
| 3,198,120 | 8/1965 | Little, Jr. | 418/9 |
| 4,328,824 | 5/1982 | Kiernan et al. | 137/99 |
| 4,606,713 | 8/1986 | Lipscombe | 418/131 |
| 4,789,314 | 12/1988 | Higuchi et al. | 418/9 |
| 4,990,069 | 2/1991 | Guitter et al. | 418/9 |
| 5,013,227 | 5/1991 | Guittet et al. . | |
| 5,338,167 | 8/1994 | Berges | 418/104 |
| 5,356,275 | 10/1994 | Brenner et al. | 418/9 |
| 5,797,734 | 8/1998 | Kizer et al. | 418/9 |
| 5,846,066 | 12/1998 | Troup | 418/3 |
| 5,888,053 | 10/1962 | Kobayashi et al. | 417/244 |

*Primary Examiner*—Thomas Denion
*Assistant Examiner*—Theresa Trieu
*Attorney, Agent, or Firm*—W. Wayne Liauh

[57] ABSTRACT

A multistage pump includes a shaft assembly and a housing and spacing plates. The shaft assembly completed by forming shafts and rotors integrally. The spacing plates defining a plurality of successive compression chambers, each chamber is delimited by two symmetrical spacing plates, there has a ring groove associated with the spacing plates, and having an elastic component placed. When the elastic component pressed by the housing, it became leakage and the clearance between the rotors and the spacing plates be easily controlled, by this way, the pump using parts are easy to manufacture, can be machined accurately and which enable highly accurate assembly to be achieved. As to the assembling method, which is characterized by mounting the high pressure end axial bearing seat and the high pressured end plate, then to control the clearance between the high pressure end plate of the bearing seat and the rotors. Furthermore, to install the spacing plates and the housing make the compression chamber formed.

1 Claim, 5 Drawing Sheets

MULTISTAGE PUMP AND METHOD FOR ASSEMBLING THE PUMP

FIELD OF INVENTION

The present invention relates to a multistage pump and a method for assembling the pump and more particularly to a method of assembling which makes the pump easy to manufacture and enables highly accurate assembly to be achieved.

BACKGROUND OF THE INVENTION

Conventionally, a vacuum system is to utilized widely in semiconductor application, in particular in the process of thin film, dry etching, ion implanting and lithography. In the vacuum technology, a vacuum pump always plays a key role to the vacuum system. Especially in a multistage pump, the precision of the pump has much to do with the assembling way. The object is to keep the clearance control the axial of the position small enough.

U.S. Pat. No. 5,013,227 describes a multistage Roots pump, wherein the rotor is fixed by clamping screws. This makes the precision of axial clearance controlled perfectly, which enables highly accurate assembly to be achieved. It still has many disadvantages. For example, the structure is relatively complicated, thereby involving high cost. Another prior art have also been developed. The shaft and the rotor completed integral with each other and the compression chamber is formed by two symmetrical housings. Such a pump is easy to assemble, but the precision of the clearance is hard to control.

SUMMARY OF THE INVENTION

The object of the invention to provide a multistage pump using parts which are easy to manufacture, which can be machined accurately. and which enables highly accurate assembly to be achieved.

It is another object of the present invention to provide a multistage pump and a method for assembling such a pump, in which the shaft assembly is formed by shaft and rotor integral with each other so as to be rapid and easy to assemble and the precision of axial clearance controlled perfect.

It is a further object of the present invention to provide a multistage pump and a method for assembling such a pump, which uses an elastic component to overcome the clearance and the leakage problems.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 1:
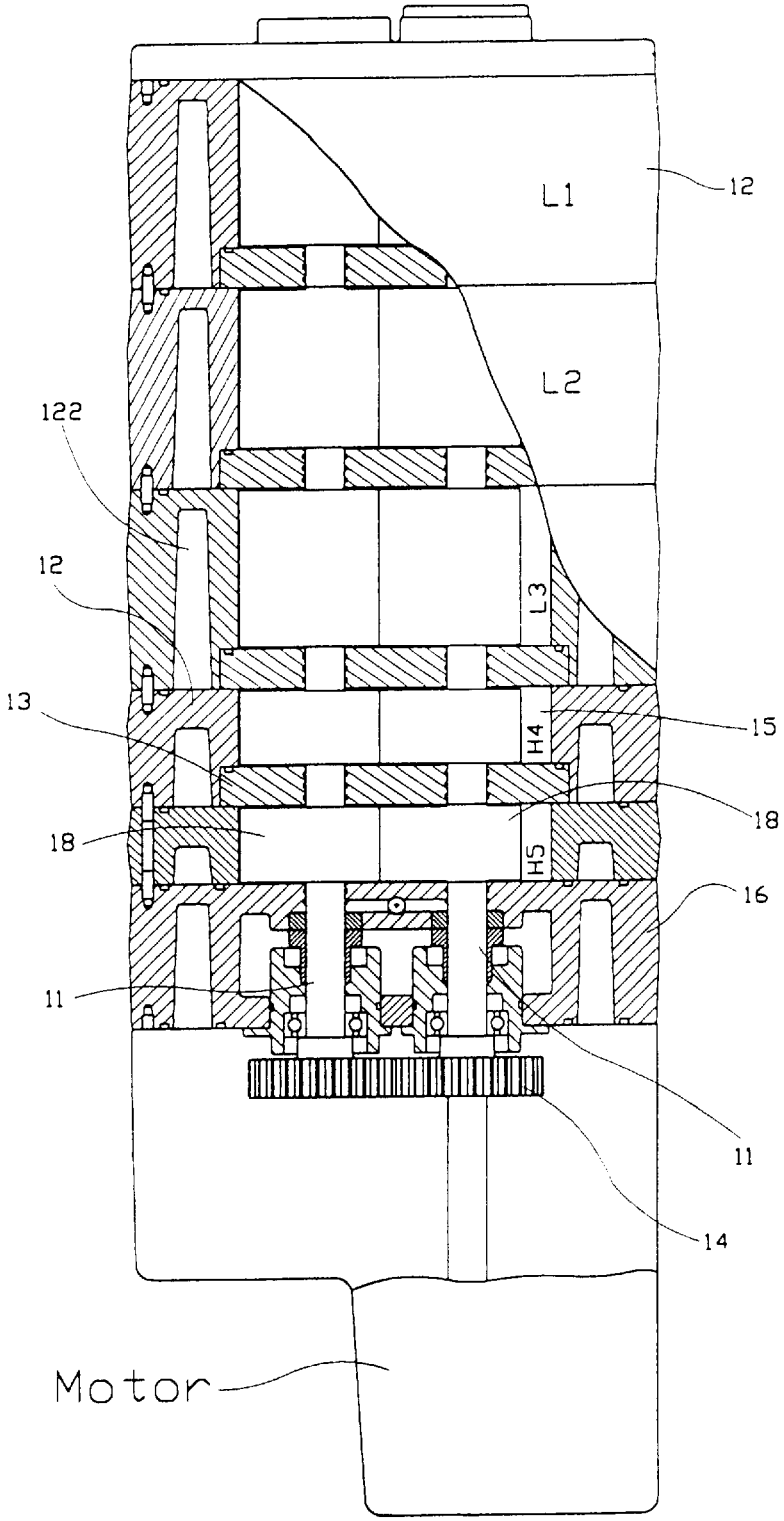
FIG. 1 is a cross-sectional view showing a multistage pump structure.
Figure 2:
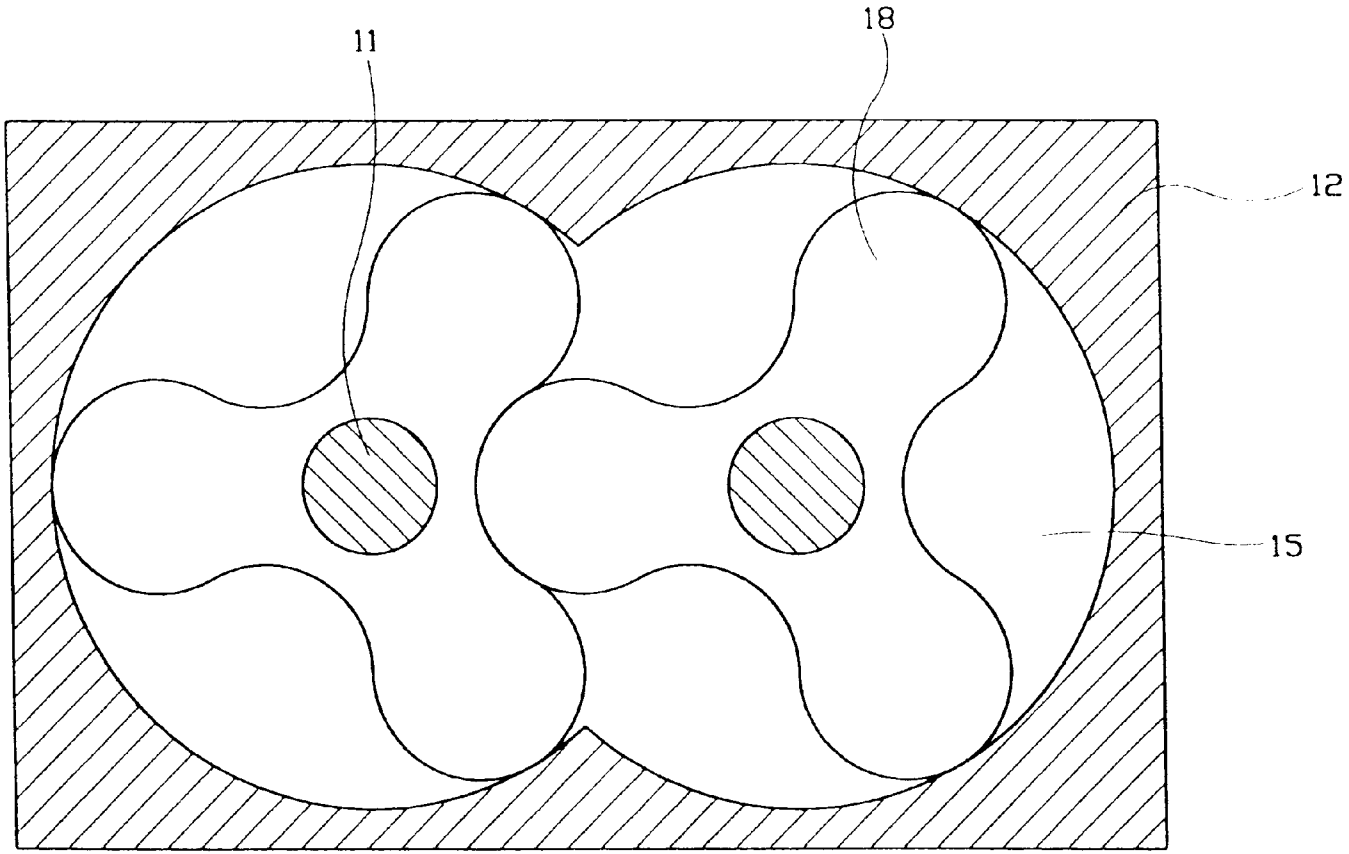
FIG. 2 is a cross-sectional view showing housing, shaft assembly and compression chamber.

With reference to FIGS. 1 and 2, a multistage pump in accordance with the present invention comprises a shaft assembly, an individual housing 12 and spacing plates 13. The shaft assembly comprises shaft 11 and rotors 18 formed integrally. The compression chamber 15 is formed by the individual housing 12 and delimited axially by adjacent two of spacing plates 13. The vacuum pump is driven by a pair of synchronizing gears 14 and it keeps the rotors 18 to maintain a 1:1 speed ratio and to make the gas transmitted, compressed and exhausted. By this way the vacuum pumping is achieved.

Figure 3:
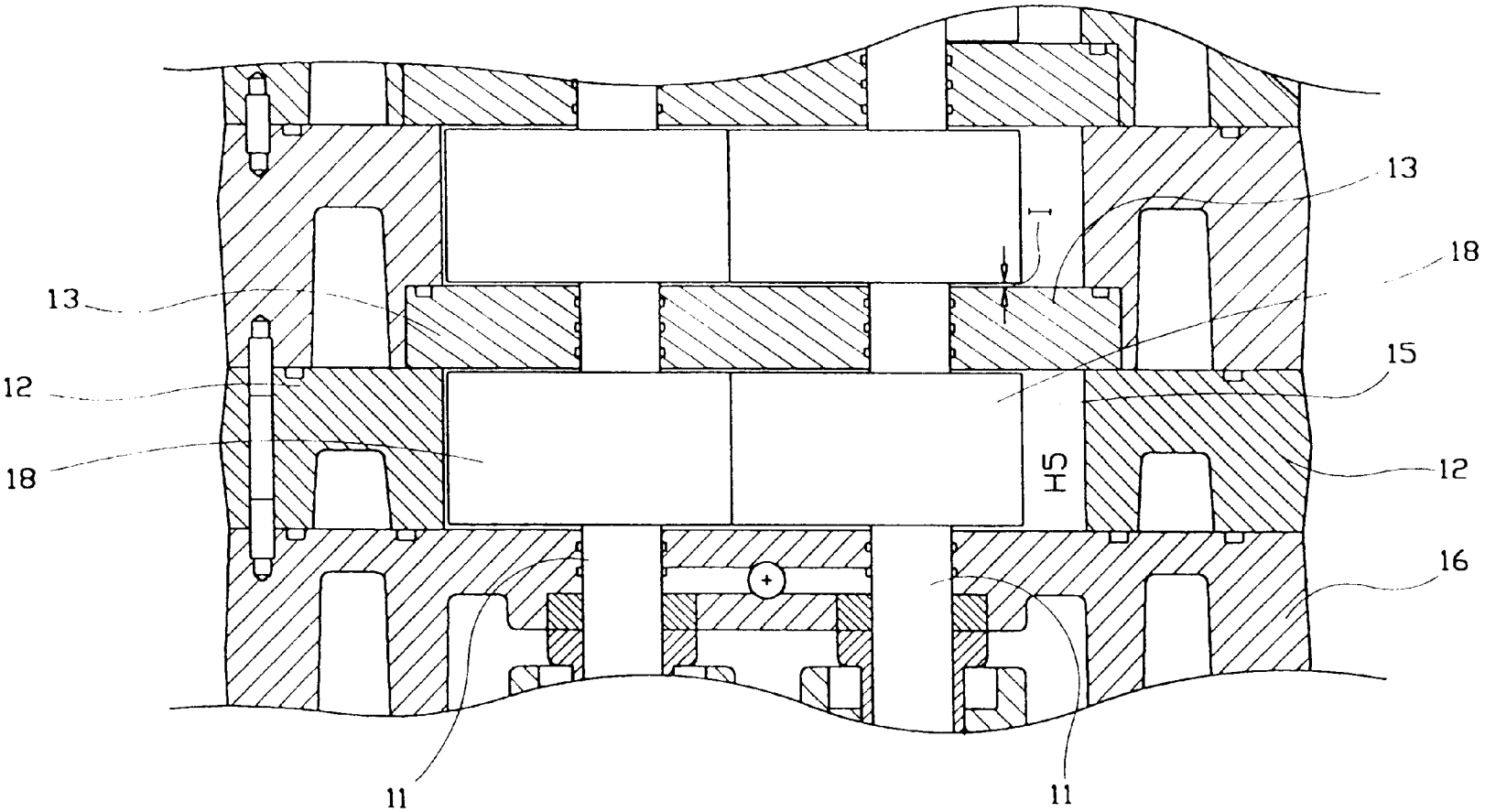
FIG. 3 is a cross-sectional view showing an axial end plate fixed to a compression chamber.

With reference to FIG. 3, to assemble the multistage pump of the invention, the method is performed from high pressure part of the compression chamber 15 (H5) to low pressure part of the compression chamber 15 (L1) in succession. To assemble the first part of the compression chamber 15 (H5), a high pressure end plate 16 is installed and the axial base surface of one end of the high pressure part of the compression chamber 15 (H5) is the end plate 16. Apparently, by adjusting the end plate 16 and the shaft assembly, the high pressure end of the compression chamber 15 (H5) makes the axial clearance between the rotors 18 and the end plate 16 in the high pressure part of the compression chamber 15 (H5) easily controlled. The compression chamber 15 is then formed. Additionally, this invention uses an elastic component which is associated with the spacing plates 13 to make the clearance I and the axial clearance of the rotors easily to control, and to obtain the aim of to assembly such a pump easily.

Figure 4:
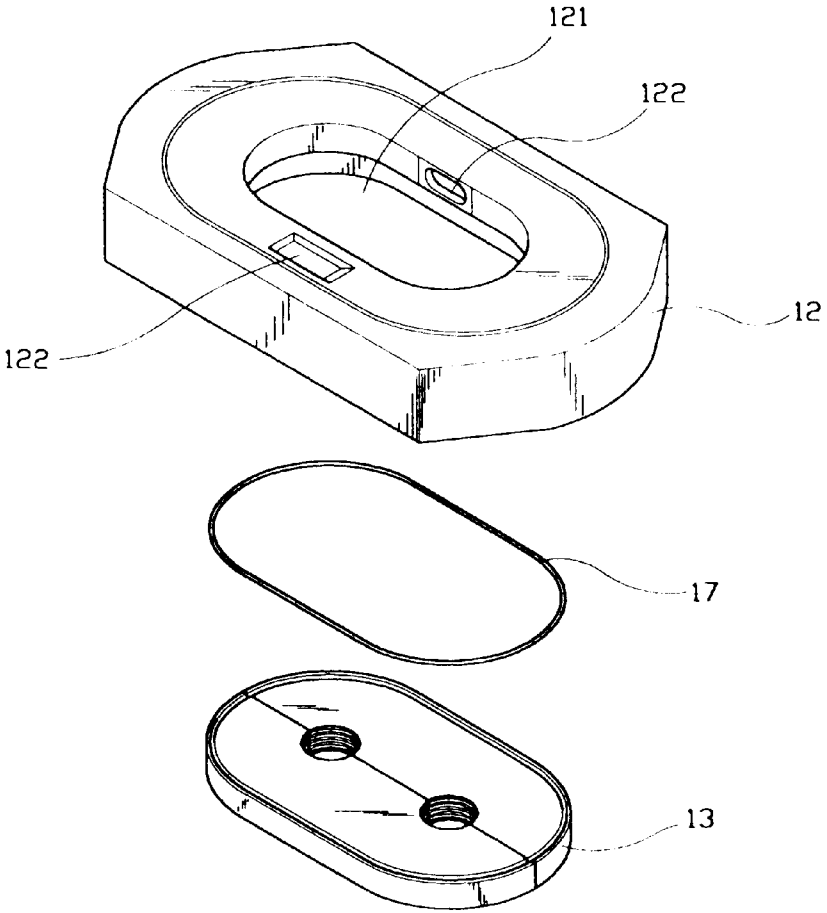
FIG. 4 is a perspective view showing the housing and the spacing plates of a compression chamber.
Figure 5:
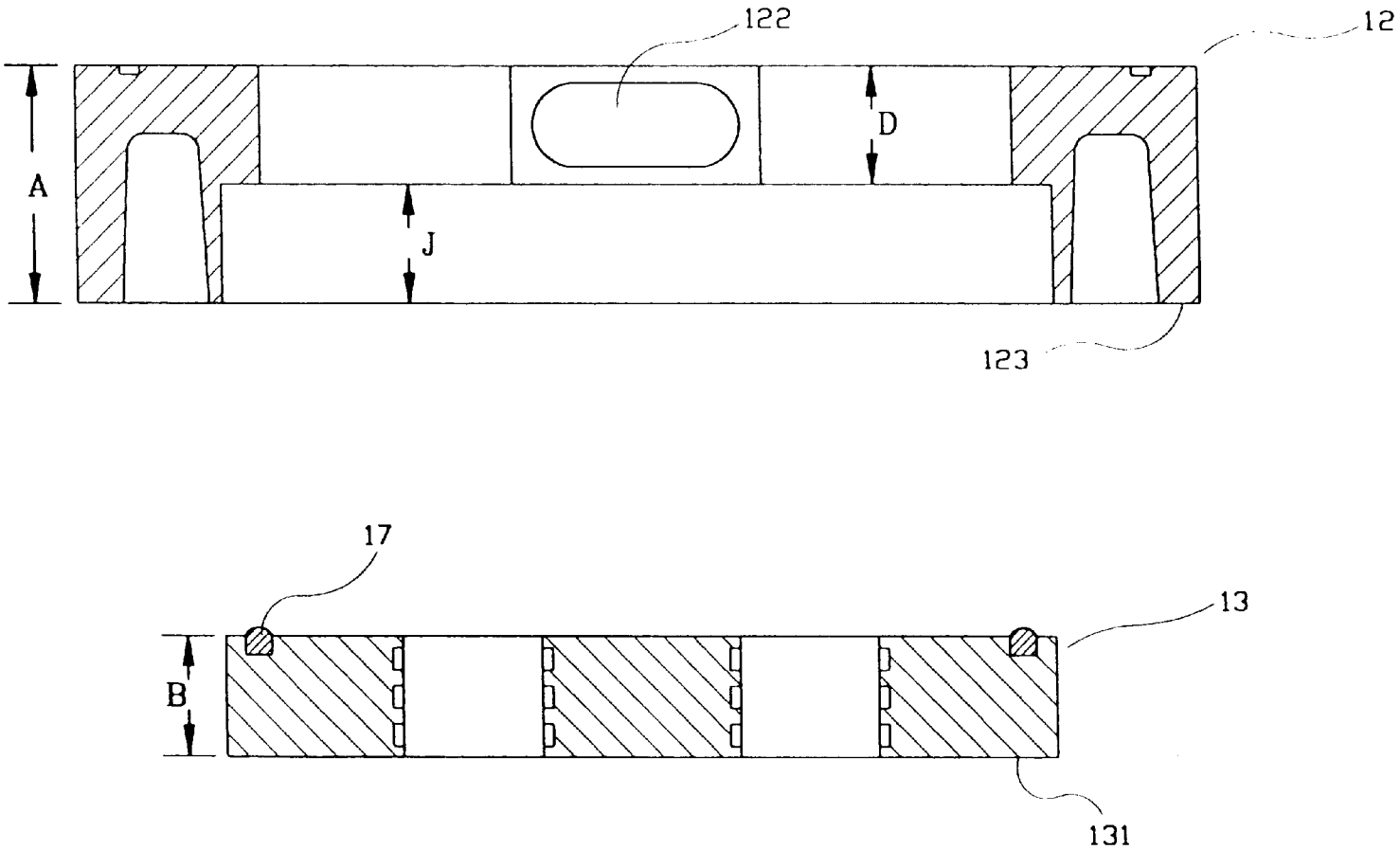
FIG. 5 is a fragmentary view showing the housing and the spacing plates of a compression chamber.

FIGS. 4 and 5 are exploded perspective views showing a multistage pump and a method assembling the pump. As depicted in the drawings, the compression chamber 15 contains the housing 12 and spacing plates 13. A cavity 121 of the housing 12 delimits the space of the compression chamber 15. The axial distance is D, and existed a hole 122 to be the expectant of the gas transmitted, compressed, exhausted. The spacing plates are formed by symmetrical plates. The symmetrical plates wedged in the shaft 11 and forming the spacing plates 13. The spacing plates 13 delimit the space of the compression chamber 15, and the spacing plates 13 have a ring groove where the elastic component 17 is placed. The width of the spacing plates 13 is the axial distance J formed by the cavity of the housing 12 ideally to maintain a suitable clearance and to prove the leakage problem when to install the housing 12 and the spacing plate 13. The elastic component 17 is disposed on the spacing plates 13. Since the elastic component 17 has an elasticity, the distance J of groove of the housing 12 is larger than the width of the spacing plates 13. The spacing plates 13 is pressed by ex-stage housing and then presses the elastic component 17. The elastic component 17 presses the spacing plates 13 to the end surface 123 of the ex-stage spacing plates, which makes the end surface 123 of the housing 12 became a plane. In this way, the leakage problem is also proved.

This invention provides a method of assembling method is characterized by the following steps:

(a) mounting the high pressure end bearing seat and the high pressure end plate;

(b) mounting the transmitting shaft and the rotors on the high pressure bearing seat;

(c) mounting the housing and forming the compression chamber (H5) on the high pressure end plate;

(d) clipping the radical direction of the spacing plates of the symmetrical plate on the shaft and then mounting the housing make the compression chamber formed.

(e) repeating steps (a) to (d) cyclically until the all compression chamber complicated;

(f) mounting the low pressure end plate and the bearings;

(g) fixing the rotors direction and mounting and the gears;

(h) adjusting the axial clearance of the rotors; and (i) mounting the connector of the motor, the canned motor and purge piping system.

By following the above steps, the shaft assembly is completed. The way to adjust the axial clearance of the rotors in the compression chamber has been seen in the prior arts and this invention just gives a detailed explanation about the housing in the compression chamber and the spacing plates, Additionally, the axial adjustment of the rotor is activated, to add a gasket between the end plate and shaft bearing make the axial clearance of the shaft be adjusted.

While this invention has been depicted and described with reference to the preferred embodiment, it will be understood by those skilled in the art that modifications and changes may be made therein while retaining the spirit and scope of the invention. It is therefore intended that the following claims include all such changes and modifications that include the true spirit and scope of the invention.

What is claimed:

1. A multistage pump comprising:

a shaft assembly, which includes a pair of shafts and a plurality of rotors wherein the shafts and the rotors are formed integrally;

an end plate provided in a bottom portion of said shaft assembly;

a first rotor housing provided immediately above said end plate for housing a first pair of interacting rotors and defining a first compression chamber therein;

a plurality of successively stacked composite housings provided above said first rotor housing;

wherein each of said composite housing comprises:

a rotor housing to house a pair of interacting rotors and define a respective compression chamber, said rotor housing also containing a through hole to allow gas to travel from one compression chamber to another;

a cavity disposed below said rotor housing and having a width greater than said rotor housing for receiving a spacing plate therein; and an O-ring received in an O-ring groove provided on an upper face of said spacing plate to define a clearance between said rotors and said spacing plate within each composite housing;

further wherein within each composite housing, said rotor has a height shorter than a height of said rotor housing, said spacing plate has a height shorter than said cavity, and each said spacing plate containing two identical half plates wedged together around said pair of shafts.

* * * * *